US011236966B2

(12) United States Patent
Liang et al.

(10) Patent No.: US 11,236,966 B2
(45) Date of Patent: Feb. 1, 2022

(54) EXPANDABLE BATON

(71) Applicant: Nextorch Industries Co., Ltd., Guangdong (CN)

(72) Inventors: Bing Liang, Guangdong (CN); Gaofang He, Guangdong (CN); Yongzhi Huang, Guangdong (CN); Dingkun Zuo, Guangdong (CN)

(73) Assignee: Nextorch Industries Co., Ltd., Guangdong (CN)

( * ) Notice: Subject to any disclaimer, the term of this patent is extended or adjusted under 35 U.S.C. 154(b) by 0 days.

(21) Appl. No.: 16/645,497

(22) PCT Filed: Apr. 18, 2019

(86) PCT No.: PCT/CN2019/083149

§ 371 (c)(1),
(2) Date: Mar. 9, 2020

(87) PCT Pub. No.: WO2020/093658

PCT Pub. Date: May 14, 2020

(65) Prior Publication Data

US 2021/0270562 A1 Sep. 2, 2021

(30) Foreign Application Priority Data

Nov. 6, 2018 (CN) ..... 201811314955.9

(51) Int. Cl.
*F41B 15/00* (2006.01)
*F41B 15/02* (2006.01)

(52) U.S. Cl.
CPC ..... *F41B 15/027* (2013.01)

(58) Field of Classification Search
CPC ..... F41B 15/027; A45B 19/04
(Continued)

(56) References Cited

U.S. PATENT DOCUMENTS 4,037,839 A * 7/1977 Nelson ..... F41B 15/027 463/47.7
6,231,447 B1 * 5/2001 Pelkey ..... F41B 15/027 403/368

(Continued)

FOREIGN PATENT DOCUMENTS

CN 201429372 Y 3/2010
CN 205118428 U 3/2016

(Continued)

*Primary Examiner* — William M Pierce
(74) *Attorney, Agent, or Firm* — Yu Gang

(57) ABSTRACT

Some embodiments of the disclosure provide an expandable baton, which includes a plurality of sleeves, a positioning ring, a plurality of locking pieces and an unlocking rod, wherein the plurality of sleeves are retractably disposed in sequence in a nesting manner; the positioning ring is provided with an avoiding hole; the plurality of locking pieces are disposed at intervals around a peripheral side of the positioning ring and enclose an avoiding space, first axial ends of the plurality of locking pieces extend into the sleeve positioned on an inner side, and second axial ends of the plurality of locking pieces extend out of the sleeve positioned on the inner side and are stuck in a sleeve, positioned on an outer side, of the two adjacent sleeves to lock two adjacent sleeves in an extending state.

9 Claims, 4 Drawing Sheets

(58) Field of Classification Search
USPC ..... 463/47.7
See application file for complete search history.

(56) References Cited

U.S. PATENT DOCUMENTS

| | | | | |
|---|---|---|---|---|
| 6,306,040 | B1 | 10/2001 | Chang | |
| 7,488,255 | B2 * | 2/2009 | Labes | F41B 15/027 135/75 |
| 10,928,158 | B2 * | 2/2021 | Kupa | F41B 15/027 |
| 2007/0087844 | A1 | 4/2007 | Labes | |
| 2013/0150167 | A1 * | 6/2013 | Pelkey | F41B 15/027 463/47.7 |
| 2014/0194212 | A1 * | 7/2014 | Walter | F41B 15/022 463/47.7 |
| 2015/0038239 | A1 * | 2/2015 | Parsons | F41B 15/027 463/47.7 |
| 2015/0038240 | A1 * | 2/2015 | Parsons | F41B 15/027 463/47.7 |
| 2016/0169616 | A1 * | 6/2016 | Cheng | F41B 15/00 463/47.7 |
| 2020/0158462 | A1 * | 5/2020 | Kupa | F41B 15/027 |

FOREIGN PATENT DOCUMENTS

| | | | |
|---|---|---|---|
| CN | 108050885 | A | 5/2018 |
| CN | 207779233 | U | 8/2018 |
| CN | 109186336 | A | 1/2019 |
| JP | 2010002149 | A | 1/2010 |
| JP | 2016017592 | A | 2/2016 |
| TW | 201510467 | A | 3/2015 |

* cited by examiner

EXPANDABLE BATON

This application is a national stage application of International Patent Application No. PCT/CN2019/083149, which is filed on Apr. 18, 2019, and claims priority to Chinese Patent Application No. 201811314955.9, filed on Nov. 6, 2018, and entitled "Expandable Baton".

TECHNICAL FIELD

The disclosure relates to a technical field of police equipment, and particularly to an expandable baton.

BACKGROUND

In an art known to inventors, a mechanical expandable baton includes a plurality of sleeves and a multi-plate type locking structure. The multi-plate type locking structure moves along a radial direction of the sleeves to implement locking and unlocking of two adjacent sleeves. However, under influence of plate type structure, the expandable baton known to the inventors has the shortcomings of many parts, complex structure, high cost, weak strength, high damage rate and the like.

SUMMARY

Some embodiments of the present disclosure provide an expandable baton, so as to solve problems of complex structure and weak strength of an expandable baton known to the inventors.

Some embodiments of the present disclosure provide an expandable baton, which includes: a plurality of sleeves, the plurality of sleeves being retractably disposed in sequence in a nesting manner; a positioning ring, the positioning ring being provided with an avoiding hole; a plurality of locking pieces, wherein the plurality of locking pieces are disposed at intervals around a peripheral side of the positioning ring and enclose an avoiding space, each of the plurality of locking piece is connected with a sleeve, positioned on an inner side, of two adjacent sleeves in the plurality of sleeves, first axial ends of the plurality of locking pieces extend into the sleeve positioned on the inner side, and second axial ends of the plurality of locking pieces extend out of the sleeve positioned on the inner side and are stuck in a sleeve, positioned on an outer side, of the two adjacent sleeves to lock the two adjacent sleeves in an extending state; and an unlocking rod, wherein the unlocking rod is retractably disposed in the sleeve, positioned on the outer side, of the two adjacent sleeves, and when the unlocking rod extends into the avoiding space and, after passing through the avoiding hole, is pressed against the first axial ends of the plurality of locking pieces, the first axial ends of the plurality of locking pieces extend outwards under a pressing action of the unlocking rod, and the each of the plurality of locking pieces rotates by taking the positioning ring as a fulcrum, so that the second axial ends of the plurality of locking pieces are radially retracted and separated from the sleeve, positioned on the outer side, and make the two adjacent sleeves in a free extension and retraction state.

In an exemplary embodiment, a clamping groove is formed in an inner wall of the sleeve, positioned on the outer side, of the two adjacent sleeves, a clamping flange is disposed at the second axial end of the each of the plurality of locking pieces, and the clamping flange extends into the clamping groove to clamp and connect the each of the plurality of locking pieces and the sleeve, positioned on the outer side, of the two adjacent sleeves; and the clamping flange withdraws from the clamping groove under a pushing action of the unlocking rod to separate the each of the plurality of locking pieces from the sleeve, positioned on the outer side, of the two adjacent sleeves.

In an exemplary embodiment, the expandable baton further includes positioning grooves formed in the plurality of locking pieces, the positioning ring includes a positioning ring body and a plurality of positioning bumps disposed on a peripheral surface of the positioning ring body in a protruding manner, the positioning bumps cooperates with the positioning grooves in a clamping manner, the plurality of locking pieces cooperate with the plurality of positioning bumps in a one-to-one correspondence manner, and the avoiding hole is formed in the positioning ring body.

In an exemplary embodiment, an avoiding groove is formed in an inner wall surface of the sleeve positioned on the inner side, of the two adjacent sleeves, so as to form a limiting bump at a pipe orifice of the sleeve, positioned on the inner side, of the two adjacent sleeves, a limiting groove is formed in an outer wall surface of the each of the plurality of locking piece, and the limiting bump extends into the limiting groove to clamp and connect the each of the plurality of locking piece and the sleeve positioned on the inner side, of the two adjacent sleeves.

In an exemplary embodiment, the expandable baton further includes an elastic ring, and the elastic ring is disposed on a peripheral side of the plurality of locking pieces in a sleeving manner.

In an exemplary embodiment, the elastic ring includes a first elastic ring and a second elastic ring, the first elastic ring is disposed at the first axial ends of the plurality of locking pieces in the sleeving manner, and the second elastic ring is disposed at the second axial ends of the plurality of locking pieces in the sleeving manner.

In an exemplary embodiment, a first positioning groove adapted to the first elastic ring is formed in a peripheral surface of the first axial end of each of the plurality of locking pieces, a second positioning groove adapted to the second elastic ring is formed in a peripheral surface of the second axial end of each of the plurality of locking pieces, and the second positioning groove is positioned between the clamping flange and the first positioning groove.

Some embodiments of the present disclosure provide an expandable baton, which includes: a plurality of sleeves, the plurality of sleeves being retractably disposed in sequence in a nesting manner; a lock body, wherein the lock body is provided with an avoiding space, a peripheral surface of the lock body is connected with a sleeve positioned on an inner side, of two adjacent sleeves in the plurality of sleeves, a first axial end of the lock body extends into the sleeve, positioned on the inner side, of the two adjacent sleeves, and a second axial end of the lock body extends out of the sleeve, positioned on the inner side, of the two adjacent sleeves and is stuck in a sleeve, positioned on an outer side, of the two adjacent sleeves, so as to lock the two adjacent sleeves in an extending state; and an unlocking rod, wherein the unlocking rod is retractably disposed in the sleeve, positioned on the outer side, of the two adjacent sleeves, and when the unlocking rod extends into the avoiding space and is pressed against the first end of the lock body, the lock body is elastically deformed under a pressing action of the unlocking rod, so that the second axial end of the lock body radially retract and separate from the sleeve, positioned on the outer side, of the two adjacent sleeves and make the two adjacent sleeves in a free extension and retraction state.

In an exemplary embodiment, the lock body includes a plurality of long-strip bodies connected end to end; or a plurality of avoiding nicks circumferentially formed at intervals are formed on the lock body, and the plurality of avoiding nicks extend along an axial direction of the lock body.

In an exemplary embodiment, a clamping groove is formed in an inner wall of the sleeve, positioned on the outer side, of the two adjacent sleeves, a clamping tooth is disposed at the second axial end of the lock body, and the clamping tooth extends into the clamping groove to clamp and connect the lock body and the sleeve, positioned on the outer side, of the two adjacent sleeves; and the clamping tooth withdraw from the clamping groove under a pushing action of the unlocking rod to separate the lock body from the sleeve, positioned on the outer side, of the two adjacent sleeves.

With adoption of the technical solutions of some embodiments of the disclosure, the positioning ring and the plurality of locking pieces are disposed on the basis of a lever principle, and the second axial ends of the plurality of locking pieces extend out of the sleeve positioned on the inner side and are stuck in the sleeve positioned on the outer side, thereby preventing axial relative movement between two adjacent sleeves and locking the two adjacent sleeves in the extending state; and the unlocking rod is pressed against the first axial ends of the locking pieces under an action of an external force, and the each of the plurality of locking pieces rotate by taking the positioning ring as the fulcrum, thereby enabling the second axial ends of the plurality of locking pieces to move towards a direction far away from the sleeve, positioned on the outer side, of the two adjacent sleeves and finally be separated from the sleeve positioned on the outer side, and making two adjacent sleeves in the free extension and retraction state.

With adoption of the technical solutions of some embodiments of the disclosure, the lock body which is deformed by use of its own elastic property is disposed on the basis of the lever principle, and the second axial end of the lock body extends out of the sleeve, positioned on the inner side, of two adjacent sleeves and is stuck in the sleeve, positioned on the outer side, of the two adjacent sleeves, thereby preventing axial relative movement between two adjacent sleeves and locking the two adjacent sleeves in the extending state; and the unlocking rod is pressed against the first axial end of the lock body under the action of the external force, and the lock body is deformed, that is, the first axial end of the lock body extends while the second axial end of the lock body retracts, until the second axial end of the lock body is separated from the sleeve, positioned on the outer side, of two adjacent sleeves, thereby making two adjacent sleeves in the free extension and retraction state.

Compared with a plate type locking structure of an expandable baton known to inventors, a locking structure of the expandable baton provided in some embodiments of the disclosure has the characteristics of simple structure and strong strength.

BRIEF DESCRIPTION OF THE DRAWINGS

The drawings forming a part of the application in the specification are adopted to provide a further understanding to the disclosure. Schematic embodiments of the disclosure and descriptions thereof are adopted to explain the disclosure and not intended to form improper limits to the disclosure. In the drawings.

Figure 1:
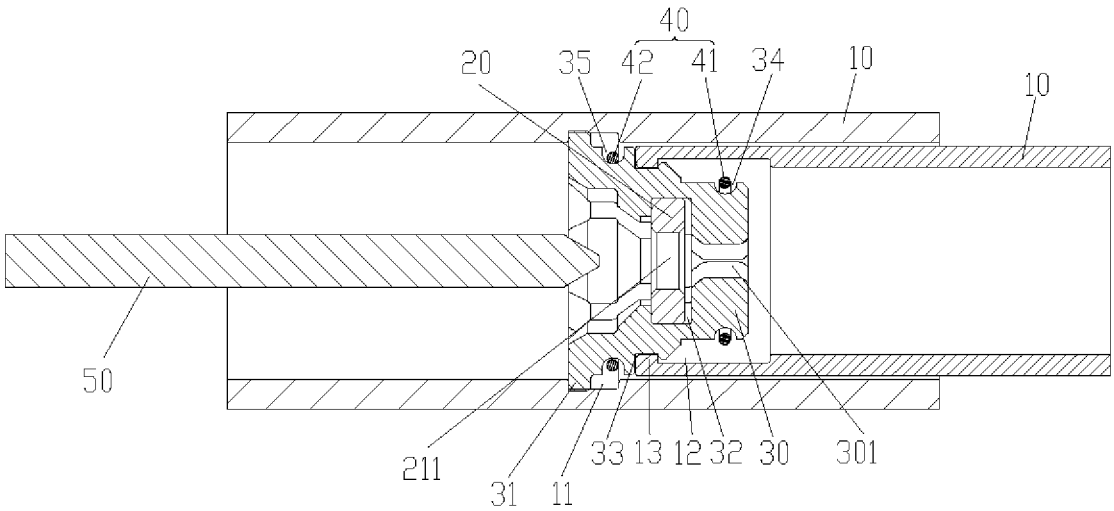
FIG. 1 illustrates a structure diagram of an expandable baton locked in an extending state according to embodiment 1 of the disclosure.

Herein, the drawings include the following drawing reference signs:

10, sleeve; 11, clamping groove; 12, avoiding groove; 13, limiting bump; 20, positioning ring; 21, positioning ring body; 211, avoiding hole; 22, positioning bump; 30, locking piece; 301, avoiding space; 31, clamping flange; 32, positioning groove; 33, limiting groove; 34, first positioning groove; 35, second positioning groove; 40, elastic ring; 41, first elastic ring; 42, second elastic ring; 50, unlocking rod; 60, lock body; 61, avoiding nick; and 62, clamping tooth.

DETAILED DESCRIPTION OF THE EMBODIMENTS

The technical solutions in embodiments of the disclosure will be clearly and completely described below in combination with the drawings in the embodiments of the disclosure. It is apparent that the described embodiments are only part of the embodiments of the disclosure but not all of the embodiments. The following description of at least one exemplary embodiment is only illustrative actually, and is not used as any limitation for the disclosure and the application or use thereof. All other embodiments obtained by those of ordinary skill in the art on the basis of the embodiments in the disclosure without creative work shall fall within the scope of protection of the disclosure.

Some embodiments of the disclosure provide an expandable baton to solve problems of complex structure and weak strength of an expandable baton known to the inventors.

Embodiment 1

As shown in FIG. 1 to FIG. 4, an expandable baton includes: a plurality of sleeves 10, a positioning ring 20, a plurality of locking pieces 30 and an unlocking rod 50. The plurality of sleeves 10 are retractably disposed in sequence in a nesting manner. The positioning ring 20 is provided with an avoiding hole 211. The plurality of locking pieces 30 are disposed at intervals around a peripheral side of the positioning ring 20 and enclose an avoiding space 301, each of the plurality of locking piece 30 is connected with a sleeve 10, positioned on an inner side, of two adjacent sleeves 10 in the plurality of sleeves, first axial ends of the plurality of locking pieces 30 extend into the sleeve 10 positioned on the inner side, and second axial ends of the plurality of locking pieces 30 extend out of the sleeve 10 positioned on the inner side and are stuck in a sleeve 10, positioned on an outer side, of the two adjacent sleeves 10 to lock the two adjacent sleeves 10 in an extending state. The unlocking rod 50 is retractably disposed in the sleeve 10, positioned on the outer side, of the two adjacent sleeves 10, and when the unlocking rod 50 extends into the avoiding space 301 and, after passing through the avoiding hole 211, is pressed against the first axial ends of the plurality of locking pieces 30, the first axial ends of the plurality of locking pieces 30 extend outwards under a pressing action of the unlocking rod 50, and the each of the plurality of locking pieces 30 rotates by taking the positioning ring 20 as a fulcrum, so that the second axial ends of the plurality of locking pieces 30 are radially retracted and separated from the sleeve 10, positioned on the outer side, of the two adjacent sleeves 10 and make the two adjacent sleeves 10 in a free extension and retraction state.

In embodiment 1, the positioning ring 20 and the plurality of locking pieces 30 are disposed on the basis of a lever principle, and the second axial ends of the plurality of locking pieces 30 extend out of the sleeve 10, positioned on the inner side, and are stuck in the sleeve 10, positioned on the outer side, of the two adjacent sleeves 10, of two adjacent sleeves 10 in the plurality of sleeves, thereby preventing axial relative movement between two adjacent sleeves 10 and locking the two adjacent sleeves in the extending state; and the unlocking rod 50 is pressed against the first axial ends of the plurality of locking pieces 30 under an action of an external force, and the each of the plurality of locking pieces 30 rotate by taking the positioning ring 20 as the fulcrum, thereby enabling the second axial ends of the plurality of locking pieces 30 to move towards a direction far away from the sleeve 10, positioned on the outer side, of the two adjacent sleeves 10 and finally be separated from the sleeve 10 positioned on the outer side, and making two adjacent sleeves in the free extension and retraction state.

Figure 2:
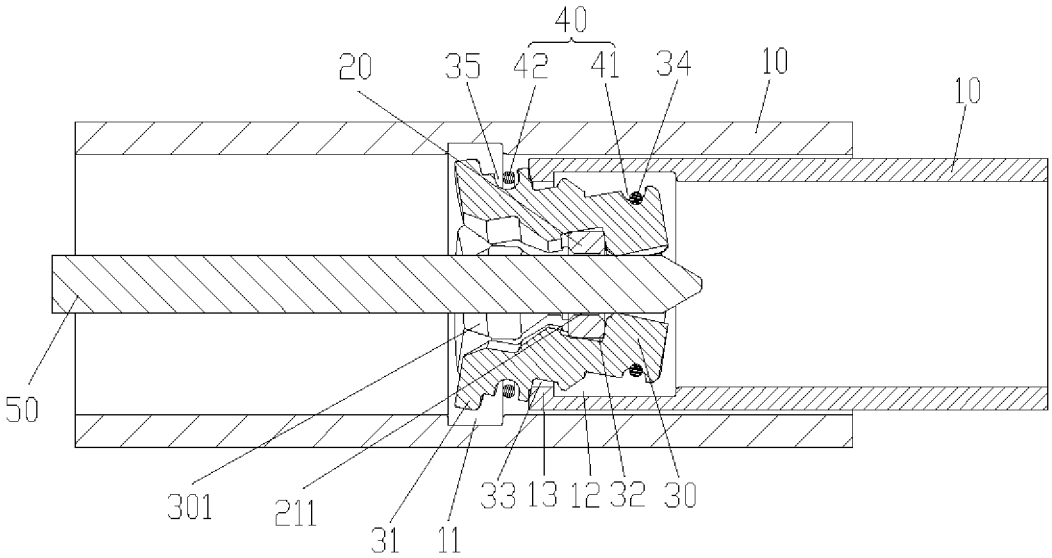
FIG. 2 illustrates a structure diagram of the expandable baton in FIG. 1 in a free extension and retraction state.

As shown in FIG. 1 and FIG. 2, a clamping groove 11 is formed in an inner wall of the sleeve 10, positioned on the outer side, of the two adjacent sleeves 10, a clamping flange 31 is disposed at the second axial end of the each of the plurality of locking pieces 30, and the clamping flange 31 extends into the clamping groove 11 to clamp and connect the each of the plurality of locking piece 30 and the sleeve 10, positioned on the outer side, of the two adjacent sleeves; and the clamping flange 31 withdraws from the clamping groove 11 under a pushing action of the unlocking rod 50 to separate the each of the plurality of locking piece 30 from the sleeve 10, positioned on the outer side, of the two adjacent sleeves 10. In such a manner, stable locking of two adjacent sleeves 10 in the extending state is ensured by use of clamping fit between the clamping flange 31 and the clamping groove 11.

Figure 4:
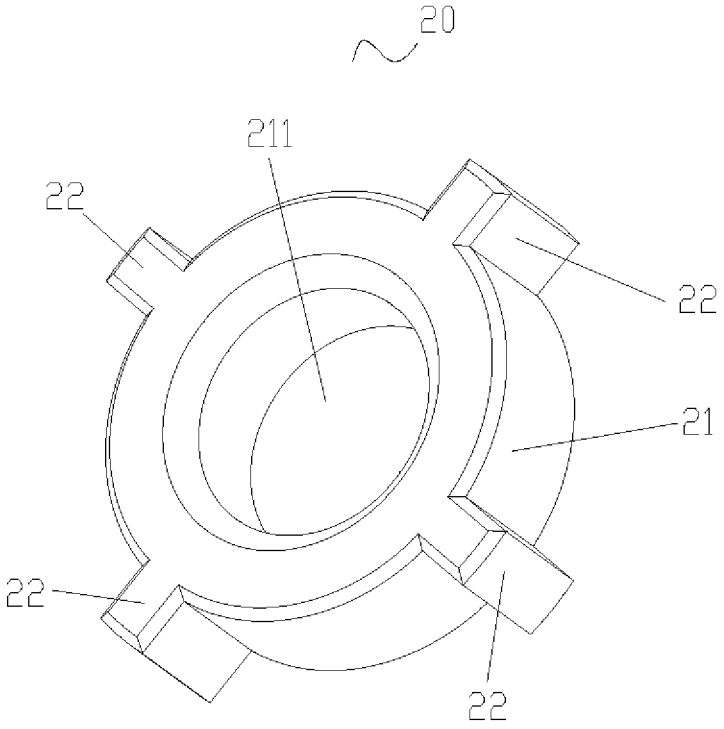
FIG. 4 illustrates a structure diagram of the positioning ring of the expandable baton in FIG. 1.

As shown in FIG. 1, FIG. 2 and FIG. 4, the expandable baton further includes positioning grooves 32 formed in the plurality of locking pieces 30, the positioning ring 20 includes a positioning ring body 21 and plurality of positioning bumps 22 disposed on a peripheral surface of the positioning ring body 21 in a protruding manner, the positioning bumps 22 cooperate with the positioning grooves 32 in a clamping manner, the plurality of locking pieces 30 cooperate with the plurality of positioning bumps 22 in a one-to-one correspondence manner, and the avoiding hole 211 is formed in the positioning ring body 21. In such a manner, the positioning grooves 32 is cooperated with the positioning bumps 22 in the clamping manner, so that connection stability between the positioning ring 20 and the plurality of locking pieces 30 is improved, and axial relative movement between the plurality of locking pieces 30 and the positioning ring 20 is avoided.

As shown in FIG. 1 and FIG. 2, an avoiding groove 12 is formed in an inner wall surface of the sleeve 10, positioned on the inner side, of the two adjacent sleeves 10, so as to form a limiting bump 13 at a pipe orifice of the sleeve 10, positioned on the inner side, of the two adjacent sleeves 10, a limiting groove 33 is formed in an outer wall surface of the each of the plurality of locking piece 30, and the limiting bump 13 extends into the limiting groove 33 to clamp and connect the each of the plurality of locking piece 30 and the sleeve 10, positioned on the inner side, of the two adjacent sleeves 10. The avoiding groove 12 has an avoiding function when the first axial end of the each of the plurality of locking pieces 30 rotates, so that interference between the each locking piece 30 and the sleeve 10 is avoided. Moreover, when the each of the plurality of locking pieces 30 rotates around the positioning ring 20, at least part of the limiting bump 13 is kept positioned in limiting grooves 33 of the plurality of locking pieces 30, so that the plurality of locking pieces 30 are prevented from being separated from the sleeve 10, positioned on the inner side, of the two adjacent sleeves 10, and stable connection between the each plurality of locking piece 30 and the sleeves 10 is ensured.

Figure 3:
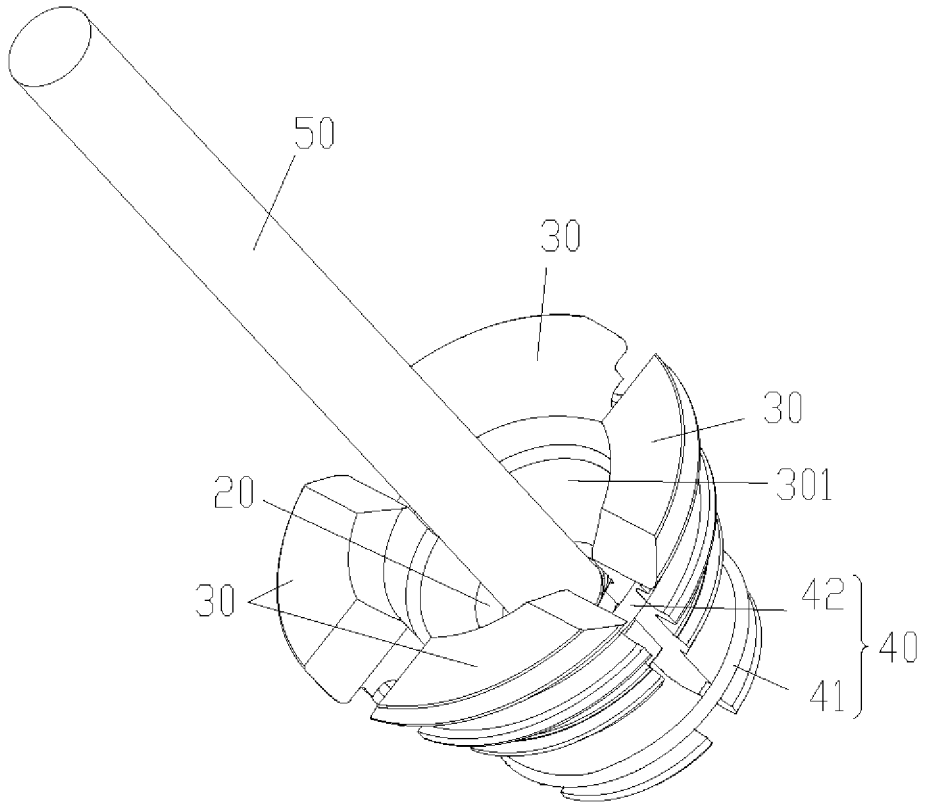
FIG. 3 illustrates a structure diagram of a positioning ring, locking pieces, an elastic ring and an unlocking rod of the expandable baton in FIG. 1.

As shown in FIG. 1 to FIG. 3, the expandable baton further includes an elastic ring 40, and the elastic ring 40 is disposed on a peripheral side of the plurality of locking pieces 30 in a sleeving manner. In such a manner, after the unlocking rod 50 withdraws from the avoiding space 301 and the avoiding hole 211, the first axial ends of the plurality of locking pieces 30 are gathered under an elastic action of the elastic ring 40, and correspondingly, the second axial ends of the plurality of locking pieces 30 extend outwards to be stuck in the sleeve 10, positioned on the outer side, of the two adjacent sleeves 10 again, so as to prevent relative movement between two adjacent sleeves 10 in an axial direction and lock the two adjacent sleeves 10 in the extending state. In addition, the elastic ring 40 also has a function of bundling the plurality of locking pieces 30 and the positioning ring 20 into a whole.

In an exemplary embodiment, the number and arrangement position of the elastic ring 40 are disposed according to a practical using requirement.

In an embodiment not shown in the drawings, only one first elastic ring 41 is disposed at the first axial end of each of the plurality of locking piece 30. After the unlocking rod 50 withdraws from the avoiding space, the locking pieces 30 are gathered and reset under the action of the first elastic ring 41, and the second axial end of the each plurality of locking piece 30 extends outwards to be stuck in the sleeve 10, positioned on the outer side, of the two adjacent sleeves 10 again, so as to prevent the axial relative movement between two adjacent sleeves 10 and lock the two adjacent sleeves 10 in the extending state.

In an optional embodiment shown in FIG. 1 to FIG. 3, the elastic ring 40 includes the first elastic ring 31 and the second elastic ring 42, and the first elastic ring 41 is disposed at the first axial ends of the plurality of locking pieces 30 in the sleeving manner, so that the first axial ends of the plurality of locking pieces 30 are gathered and reset under the action of the first elastic ring 41; and the second elastic ring 42 is disposed at the second axial ends of the plurality of locking pieces 30 in the sleeving manner, so that it is ensured that the positioning ring 20 is stably stuck in the plurality of locking pieces 30, and the plurality of locking pieces 30 and the positioning ring 20 are bundled into a whole locking structure.

In an exemplary embodiment, the elastic ring 40 is a sealing ring, a spring or another elastic element.

In an exemplary embodiment, the elastic ring 40 is made from rubber or silica gel.

As shown in FIG. 1 and FIG. 2, a first positioning groove 34 adapted to the first elastic ring 41 is formed in a peripheral surface of the first axial end of the each of the plurality of locking pieces 30, a second positioning groove 35 adapted to the second elastic ring 42 is formed in a peripheral surface of the second axial end of each of the plurality of locking piece 30, and the second positioning groove 35 is positioned between the clamping flange 31 and the first positioning groove 34. In such a manner, the first elastic ring 41 is positioned by use of the first positioning groove 34 to ensure connection stability between the first elastic ring 41 and the plurality of locking pieces 30, and the second elastic ring 42 is positioned by use of the second positioning groove 35 to ensure connection stability between the second elastic ring 42 and the plurality of locking pieces 30.

Embodiment 2

Figure 5:
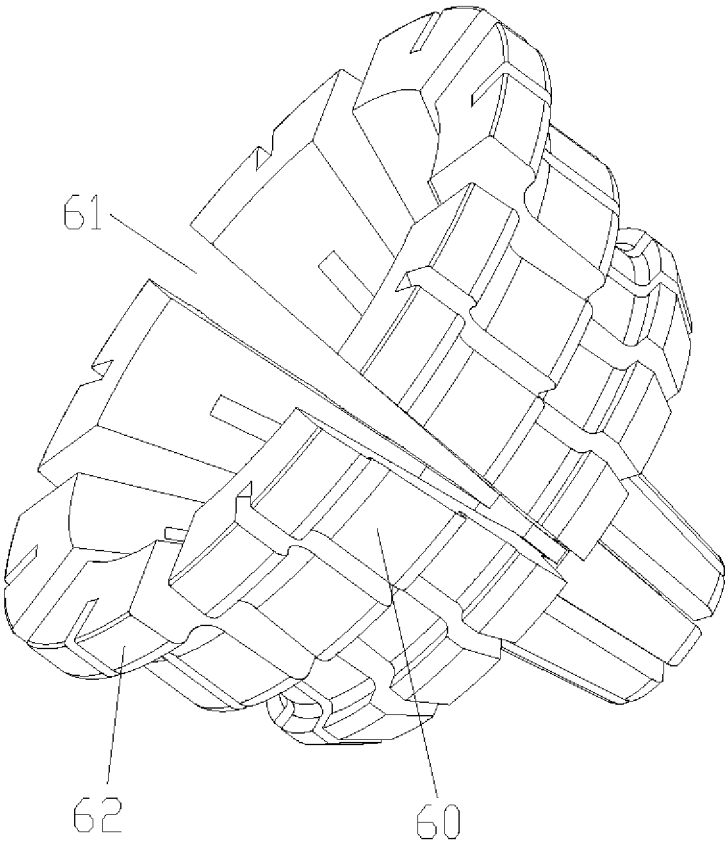
FIG. 5 illustrates a structure diagram of a lock body of an expandable baton according to embodiment 2 of the disclosure.

The difference between embodiment 2 and embodiment 1 is that a lock body 60 of an integrated structure is provided as shown in FIG. 5, thereby further reducing the number of parts of the expandable baton and improving assembling efficiency of the expandable baton. An expandable baton includes: a plurality of sleeves 10, a lock body 60 and an unlocking rod 50. The plurality of sleeves 10 are retractably disposed in sequence in a nesting manner. The lock body 60 is provided with an avoiding space 301, a peripheral surface of the lock body 60 is connected with a sleeve 10, positioned on an inner side, of two adjacent sleeves 10, a first axial end of the lock body 60 extends into the sleeve 10, positioned on the inner side, of two adjacent sleeves 10, and a second axial end of the lock body 60 extends out of the sleeve 10, positioned on the inner side, of two adjacent sleeves 10 and is stuck in a sleeve 10, positioned on an outer side, of two adjacent sleeves 10, so as to lock the two adjacent sleeves 10 in an extending state. The unlocking rod 50 is retractably disposed in the sleeve 10, positioned on the outer side, of two adjacent sleeves 10, and when the unlocking rod 50 extends into the avoiding space 301 and is pressed against the first end of the lock body 60, the lock body 60 is elastically deformed under a pressing action of the unlocking rod 50, so that the second axial end of the lock body 60 radially retract and separate from the sleeve 10, positioned on the outer side, of two adjacent sleeves 10 and make the two adjacent sleeves 10 in a free extension and retraction state.

In embodiment 2, the lock body 60 which is deformed by use of its own elastic property is disposed on the basis of a lever principle, and the second axial end of the lock body 60 extends out of the sleeve 10, positioned on the inner side, of two adjacent sleeves 10 and is stuck in the sleeve 10, positioned on the outer side, of two adjacent sleeves 10, thereby preventing axial relative movement between the two adjacent sleeves 10 and locking the two adjacent sleeves in the extending state; and the unlocking rod 50 is pressed against the first axial end of the lock body 60 under the action of the external force, and the lock body 60 is deformed, that is, the first axial end of the lock body 60 extends while the second axial end of the lock body 60 retracts, until the second axial end of the lock body 60 is separated from the sleeve 10, positioned on the outer side, of two adjacent sleeves 10, thereby making the two adjacent sleeves in the free extension and retraction state.

In an exemplary embodiment, the lock body 60 includes a plurality of long-strip bodies connected end to end. Therefore, a deformation space is formed between two adjacent long-strip bodies, and the deformation space has an avoiding function when the lock body 60 is deformed and retracts.

In an exemplary embodiment, a plurality of avoiding nicks 61 circumferentially formed at intervals are formed on the lock body 60, the plurality of avoiding nicks 61 extend along an axial direction of the lock body 60, and the avoiding nicks 61 have the avoiding function when the lock body 60 is deformed and retracts.

In an exemplary embodiment, a clamping groove 11 is formed in inner wall of the sleeve 10, positioned on the outer side, of two adjacent sleeves 10, a clamping tooth 62 is disposed at the second axial end of the lock body 60, and the clamping tooth 62 extends into the clamping groove 11 to clamp and connect the lock body 60 with the sleeve 10, positioned on the outer side, of two adjacent sleeves 10; and the clamping tooth 62 withdraw from the clamping grooves 11 under a pushing action of the unlocking rod 50 to separate the lock body 60 from the sleeve 10, positioned on the outer side, of two adjacent sleeves 10. In such a manner, the lock body 60 cooperates with the clamping groove 11 of the sleeve 10, positioned on the outer side, of two adjacent sleeves 10 through the clamping tooth 62 to ensure that the two adjacent sleeves 10 are stably locked in the extending state.

Compared with a plate type locking structure of an expandable baton known to the inventors, a locking structure of the expandable baton provided in the disclosure has the characteristics of simple structure and strong strength.

It is to be noted that terms used herein are only adopted to describe specific implementation modes and not intended to limit exemplary implementation modes according to the application. For example, singular forms, used herein, are also intended to include plural forms, unless otherwise clearly pointed out. In addition, it is also to be understood that terms "contain" and/or "include" used in the specification refer/refers to existence of features, steps, operations, apparatuses, components and/or combinations thereof.

Unless otherwise specified, relative arrangements of components and steps elaborated in these embodiments, numeric expressions and numeric values do not limit the scope of the disclosure. Furthermore, it should be understood that for ease of descriptions, the size of each part shown in the drawings is not drawn in accordance with an actual proportional relation. Technologies, methods and devices known by those of ordinary skill in the art may not be discussed in detail. However, where appropriate, the technologies, the methods and the devices shall be regarded as part of the authorized description. In all examples shown and discussed herein, any specific values shall be interpreted as only exemplar values instead of limited values. As a result, other examples of the exemplary embodiments have different values. It is to be noted that similar marks and letters represent similar items in the following drawings. As a result, once a certain item is defined in one drawing, it is unnecessary to further discus the certain item in the subsequent drawings.

In the descriptions of the disclosure, it will be appreciated that locative or positional relations indicated by "front, back, up, down, left, and right", "horizontal, vertical, perpendicular, and horizontal", "top and bottom" and other terms are locative or positional relations shown on the basis of the drawings, which are only intended to make it convenient to describe the disclosure and to simplify the descriptions without indicating or impliedly indicating that the referring device or element must have a specific location and must be constructed and operated with the specific location, and accordingly it cannot be understood as limitations to the disclosure.

For ease of description, spatial relative terms such as "over", "above", "on an upper surface" and "upper" may be used herein for describing a spatial position relation between a device or feature and other devices or features shown in the drawings. It will be appreciated that the spatial relative terms aim to contain different orientations in usage or operation besides the orientations of the devices described in the drawings. For example, if the devices in the drawings are inverted, devices described as "above other devices or structures" or "over other devices or structures" will be located as "below other devices or structures" or "under other devices or structures". Thus, an exemplar term "above" may include two orientations namely "above" and "below". The device may be located in other different modes (rotated by 90 degrees or located in other orientations), and spatial relative descriptions used herein are correspondingly explained.

In addition, it is to be noted that terms "first", "second" and the like are used to limit parts, and are only intended to distinguish corresponding parts. If there are no otherwise statements, the above terms do not have special meanings, such that they cannot be understood as limits to the scope of protection of the present disclosure.

It is to be noted that terms used herein are only adopted to describe specific implementation modes and not intended to limit exemplary implementation modes according to the application. For example, singular forms, used herein, are also intended to include plural forms, unless otherwise clearly pointed out. In addition, it is also to be understood that terms "contain" and/or "include" used in the specification refer/refers to existence of features, steps, work, apparatuses, components and/or combinations thereof.

It is to be noted that terms like "first" and "second" in the specification, claims and drawings of the application are adopted not to describe a specific sequence or order but to distinguish similar objects. It is to be understood that data used like this may be exchanged under a proper condition for implementation of the implementation modes, described herein, of the application in sequences besides those shown or described here.

The above is only some embodiments of the disclosure and not intended to limit the disclosure. For those skilled in the art, the disclosure may have various modifications and variations. Any modifications, equivalent replacements, improvements and the like made within the spirit and principle of the disclosure shall fall within the scope of protection of the disclosure.

What is claimed is:

1. An expandable baton, comprising:

a plurality of sleeves, the plurality of sleeves being retractably disposed in sequence in a nesting manner;

a positioning ring, the positioning ring being provided with an avoiding hole;

a plurality of locking pieces, wherein the plurality of locking pieces are disposed at intervals around a peripheral side of the positioning ring and enclose an avoiding space, each of the plurality of locking pieces is connected with a sleeve, positioned on an inner side, of two adjacent sleeves in the plurality of sleeves, first axial ends of the plurality of locking pieces extend into the sleeve—positioned on the inner side, and second axial ends of the plurality of locking pieces extend out of the sleeve positioned on the inner side and are stuck in a sleeve, positioned on an outer side, of the two adjacent sleeves to lock the two adjacent sleeves in an extending state; and an unlocking rod, wherein the unlocking rod is retractably disposed in the sleeve which is on the outer side of the two adjacent sleeves, and when the unlocking rod extends into the avoiding space and, after passing through the avoiding hole, is pressed against the first axial ends of the plurality of locking pieces, the first axial ends of the plurality of locking pieces extend outwards under a pressing action of the unlocking rod, and the each of the plurality of locking pieces rotates by taking the positioning ring as a fulcrum, so that the second axial ends of the plurality of locking pieces are radially retracted and separated from the sleeve, positioned on the outer side, of the two adjacent sleeves and make the two adjacent sleeves in a free extension and retraction state;

wherein the expandable baton further comprises positioning grooves formed in the plurality of locking pieces, the positioning ring comprises a positioning ring body and the avoiding hole is formed in the positioning ring body, the positioning ring body is disposed in each positioning groove;

wherein a clamping groove is formed in an inner wall of the sleeve, positioned on the outer side, of the two adjacent sleeves, a clamping flange is disposed at the second axial end of the each of the plurality of locking pieces, and the clamping flange extends into the clamping groove to clamp and connect the each of the plurality of locking pieces and the sleeve, positioned on the outer side, of the two adjacent sleeves; and the clamping flange withdraws from the clamping groove under a pushing action of the unlocking rod to separate the each of the plurality of locking pieces from the sleeve, positioned on the outer side, of the two adjacent sleeves.

2. The expandable baton as claimed in claim 1, wherein the positioning ring comprises a plurality of positioning bumps disposed on a peripheral surface of the positioning ring body in a protruding manner, the plurality of positioning bumps cooperates with the positioning grooves in a clamping manner, the plurality of locking pieces cooperates with the plurality of positioning bumps in a one-to-one correspondence manner.

3. The expandable baton as claimed in claim 1, wherein an avoiding groove is formed in an inner wall surface of the sleeve, positioned on the inner side, of the two adjacent sleeves, so as to form a limiting bump at a pipe orifice of the sleeve, positioned on the inner side, of the two adjacent sleeves, a limiting groove is formed in an outer wall surface of the each of the plurality of locking pieces, and the limiting bump extends into the limiting groove to clamp and connect the each of the plurality of locking piece and the sleeve, positioned on the inner side, of the two adjacent sleeves.

4. The expandable baton as claimed in claim 1, further comprising an elastic ring, wherein the elastic ring is disposed on a peripheral side of the plurality of locking pieces in a sleeving manner.

5. The expandable baton as claimed in claim 4, wherein the elastic ring comprises a first elastic ring and a second elastic ring, the first elastic ring is disposed at the first axial ends of the plurality of locking pieces in the sleeving manner, and the second elastic ring is disposed at the second axial ends of the plurality of locking pieces in the sleeving manner.

6. The expandable baton as claimed in claim 5, wherein a first positioning groove adapted to the first elastic ring is formed in a peripheral surface of the first axial end of each of the plurality of locking pieces, a second positioning groove adapted to the second elastic ring is formed in a peripheral surface of the second axial end of each of the plurality of locking pieces, and the second positioning groove is positioned between the clamping flange and the first positioning groove.

7. An expandable baton, comprising:

a plurality of sleeves, the plurality of sleeves being retractably disposed in sequence in a nesting manner;

a lock body, wherein the lock body is provided with an avoiding space, a peripheral surface of the lock body is connected with a sleeve, positioned on an inner side, of two adjacent sleeves in the plurality of sleeves, a first axial end of the lock body extends into the sleeve, positioned on the inner side, of the two adjacent sleeves, and a second axial end of the lock body extends out of the sleeve, positioned on the inner side, of the two adjacent sleeves and is stuck in a sleeve, positioned on an outer side, of the two adjacent sleeves, so as to lock the two adjacent sleeves in an extending state; and an unlocking rod, wherein the unlocking rod is retractably disposed in the sleeve which is positioned on the outer side of the two adjacent sleeves, and when the unlocking rod extends into the avoiding space and is pressed against the first end of the lock body, the lock body is elastically deformed under a pressing action of the unlocking rod, so that the second axial end of the lock body retract and separate radially from the sleeve, positioned on the outer side, of the two adjacent sleeves and make the two adjacent sleeves in a free extension and retraction state.

8. The expandable baton as claimed in claim 7, wherein the lock body comprises a plurality of long-strip bodies connected end to end; or a plurality of avoiding nicks circumferentially formed at intervals are formed on the lock body, and the plurality of avoiding nicks extend along an axial direction of the lock body.

9. The expandable baton as claimed in claim 7, wherein a clamping groove is formed in an inner wall of the sleeve, positioned on the outer side, of the two adjacent sleeves, a clamping tooth is disposed at the second axial end of the lock body, and the clamping tooth extends into the clamping groove to clamp and connect the lock body and the sleeve, positioned on the outer side, of the two adjacent sleeves; and the clamping tooth withdraws from the clamping groove under a pushing action of the unlocking rod to separate the lock body from the sleeve, positioned on the outer side, of the two adjacent sleeves.

* * * * *